United States Patent [19]

Allen

[11] 4,179,796

[45] Dec. 25, 1979

[54] METHOD OF MAKING A TRANSFORMER WITH AN IMPROVED INSULATION SYSTEM

[75] Inventor: Richard Allen, Richardson, Tex.

[73] Assignee: Varo Semiconductor, Inc., Garland, Tex.

[21] Appl. No.: 886,125

[22] Filed: Mar. 13, 1978

[51] Int. Cl.[2] ..... H01F 41/12

[52] U.S. Cl. ..... 29/605; 264/269; 264/272; 336/205

[58] Field of Search ..... 29/605, 602 R; 336/205, 336/96; 264/272, 269

[56] References Cited

U.S. PATENT DOCUMENTS

| | | | |
|---|---|---|---|
| 2,856,639 | 10/1958 | Forrest et al. | 336/205 X |
| 3,348,302 | 10/1967 | Foerster | 29/605 |
| 3,559,134 | 1/1971 | Daley | 336/205 X |

*Primary Examiner*—Carl E. Hall

*Attorney, Agent, or Firm*—Trexler, Wolters, Bushnell & Fosse, Ltd.

[57] ABSTRACT

A potted transformer winding and a method of manufacturing the same are disclosed. The method of manufacture includes the steps of inserting a temporary core pin in a hollow bobbin, winding a first coil of wire on the bobbin, placing a bobbin sleeve over the bobbin, and winding a second coil of wire on the sleeve to form a transformer winding assembly. Other sleeves and coils can be provided if desired. The transformer winding assembly is located in the interior of a casing, the casing and winding are heated, the casing interior and winding are subjected to a vacuum, and a potting compound is introduced into the casing interior in continuation of the vacuum and heat. The potting compound then flows between the core pin and the bobbin to form an electrically insulative coating inside the bobbin hollow. After the casing, winding and potting compound have cooled, at least one hole is formed in the casing adjacent an end of the pin and the pin is removed from the bobbin casing. A leg of a transformer core member may then be inserted into the cylindrical space defined by the thus exposed potting compound layer.

5 Claims, 5 Drawing Figures

10
11
12
21
22
24
25
26
27
28
29
32
33
34
35
36
44
45
2

METHOD OF MAKING A TRANSFORMER WITH AN IMPROVED INSULATION SYSTEM

BACKGROUND OF THE INVENTION

This invention relates generally to flyback transformers and like electrical devices and more particularly concerns a novel embodiment of at least one segment of such a transformer, and a method of manufacturing the device.

Flyback transformers are used extensively in domestic television receivers and other electronic devices to provide suitable voltage and current to other circuit components. These transformers usually include a large number of turns of fine wire comprising a secondary winding which is commonly encased within a housing. A primary winding and a transformer core are associated with the secondary winding in any of a variety of ways. In addition, a potting compound is often introduced to the wire coils and housing interior in order to provide mechanical stability and improve various electrical characteristics of the unit.

Since vast numbers of transformers are required by the television industry, the method by which these devices are manufactured must be economical and efficient; and small increments in manufacturing costs can make the difference between a highly profitable operation and considerable financial difficulty. Furthermore, the finished transformer must meet rigid electrical performance specifications and operate satisfactorily over a long service life. Failure to meet these criteria can severely impair the component manufacturer's reputation within the trade.

It is accordingly an important object of the present invention to provide a method of manufacturing a flyback transformer unit which facilitates manufacture at low cost, yet provides a high-quality end product.

Another object of the invention is to provide a transformer winding which is especially adapted to receive a portion of a particular transformer core, which is provided throughout with invested potting compound, and which can be offered at an attractive unit cost.

A related object is to provide, at an attractive cost, a winding assembly which is fully invested with potting compound, even to the extent of including a layer of compound inside the winding core adjacent the space to be occupied by the transformer core member leg.

Other objects and advantages of the invention will become apparent upon reading the following detailed description and upon reference to the drawings. Throughout the drawings, like reference numerals have been used to refer to like parts.

DETAILED DESCRIPTION

While the invention will be described in connection with a preferred embodiment and procedure, it will be understood that it is not intended to limit the invention to this embodiment or procedure. On the contrary, it is intended to cover all alternatives, modifications and equivalents as may be included within the spirit and scope of the invention as defined by the appended claims.

Figure 4:
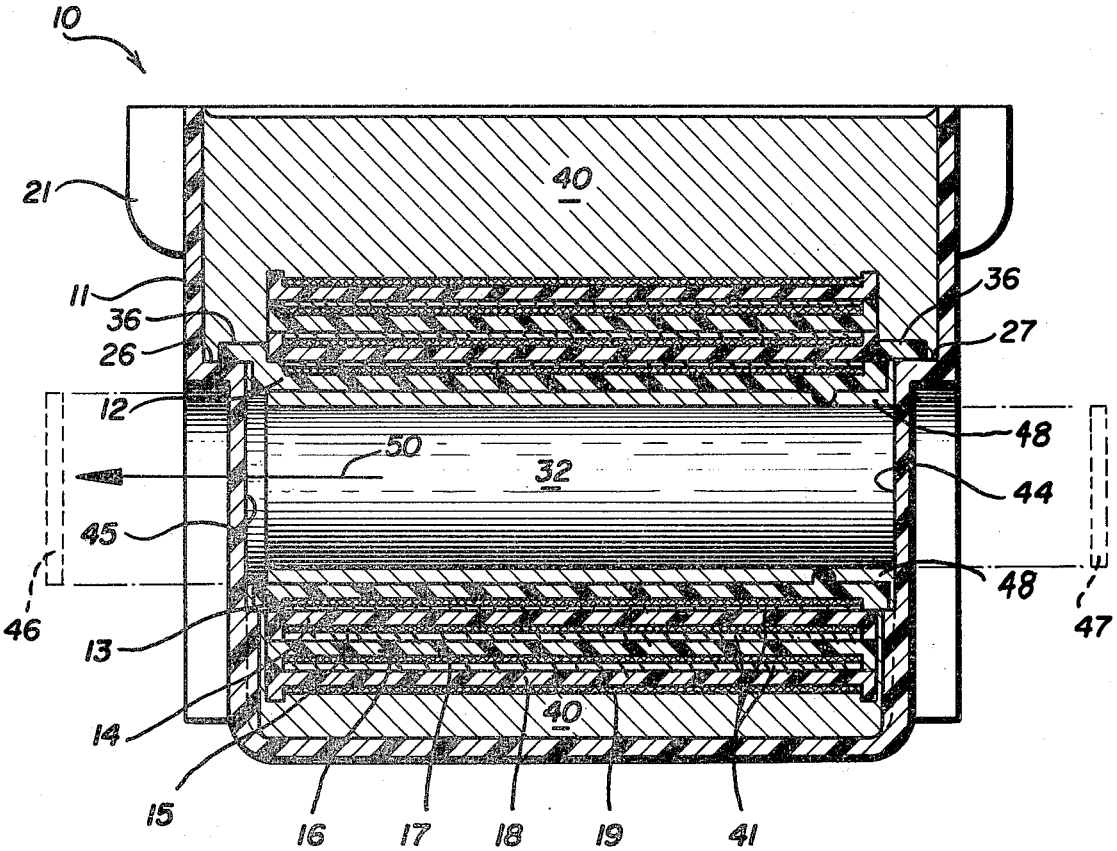
FIG. 4 is a side elevational view taken in section, the figure being similar to FIG. 2 but showing the transformer winding as it appears in an intermediate constructional state with the temporary core pin and potting compound in place around the various sleeves and windings.

More particularly, the drawings illustrate an electromechanical device 10 which comprises the secondary winding of a flyback transformer especially adapted for use in domestic television receivers and the like. As is best shown in FIG. 4, the device 10 includes an outer, insulating casing or housing 11 within which is carried a tubular bobbin 12. A first coil of copper or other conductive wire 13 is wound upon this bobbin 12 and a first bobbin sleeve 14 is telescoped over both the hollow bobbin 12 and the first wire coil 13. Upon this first sleeve 14 is wound a second wire coil 15. A second bobbin sleeve 16 surrounds the first sleeve 14 and the second coil 15; and a third coil 17 of wire is wound upon this second sleeve 16. In like manner, a third sleeve 18 is fitted over the second sleeve 17; and a fourth coil of wire 19 is carried upon this outer or third sleeve 18. As will be appreciated, the housing, bobbin and sleeves are fabricated from a suitable resinous plastic material; and suitable electrical connections are made between the various coils.

Figures 1, 2, 3:
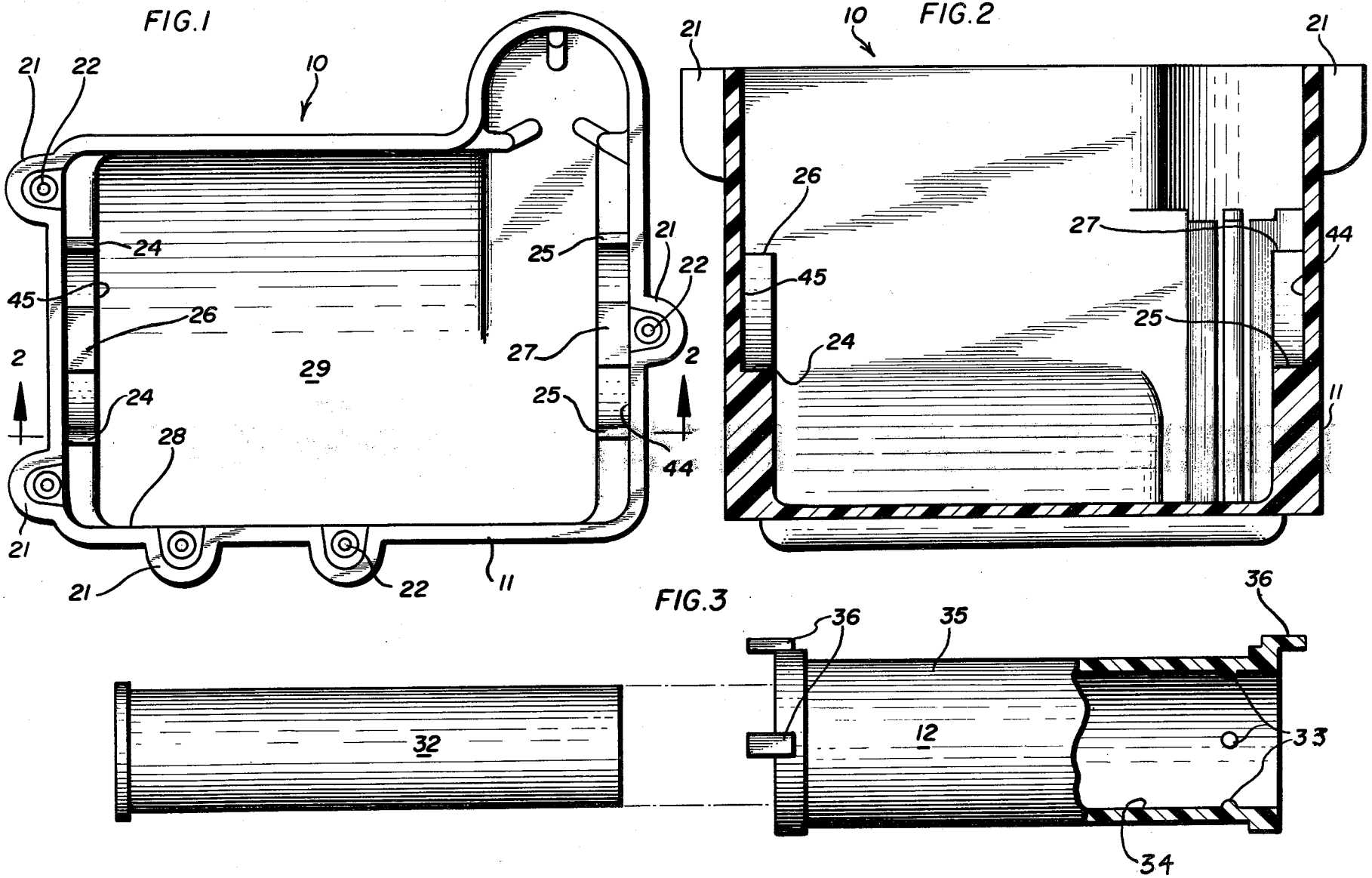
FIG. 1 is a plan view looking into the open end of a winding casing or housing for use in the present invention.
FIG. 2 is a side elevational view taken in section in substantially the plane of line 2—2 in FIG. 1.
FIG. 3 is an exploded and partially cutaway view of a winding bobbin and accompanying core pin used in the invention.

The casing 11 is provided with embossments 21 for receiving electrical connector or mounting pins 22 as is shown in FIG. 2; and bobbin mounting structure comprising pairs of ledges 24 and 25 and associated mounting flats 26 and 27 is also formed upon the casing interior surface 28. Within this housing or casing 11, the bobbin 12 will ultimately be secured.

In accordance with the invention, provision is made for the association of the finished device 10 with a transformer core member (not shown) in the course of component manufacture. To this end, a temporary cylindrical core pin 32, which is headed at one end, is inserted within bobbin 12 to be temporarily retained against axial dislocation in one direction by a suitable number of radially inwardly extending embossments 33 formed on the interior surface 34 of the bobbin adjacent one end thereof, as is shown in FIG. 3. The embossments 33 cooperate with the flanged head of pin 32 in maintaining a uniform spacing between these parts; and as will be appreciated, embossments or other discontinuous spacers may be substituted for the flanged head of pin 32. Upon the outer surface 35 of bobbin 12 there is wound the first coil of wire. Furthermore, the core pin 32 may be fabricated from metal or from a thermally resistant, antifriction material such as polytetrafluoroethylene resin.

After the first wire coil 13 has been wound upon the bobbin 12, the second sleeve 14 is slipped axially over bobbin 12 and over the first wire coil 13. The second wire coil 15 is then wound upon the sleeve 14. In the same manner, additional sleeves 16 and 18 of progressively greater diametric size can be axially installed over preceding sleeves and over the corresponding wire coils 15, 17 (and, when necessary, 19). This winding assembly consisting of bobbin 12, the invaginated core pin 32, sleeves 14, 16 and 18 and wire coils 15, 17 and 19 is then mounted within the cavity 29 defined by the casing interior surface 28. To this end, the bobbin 12 is provided with a suitable number of axially extending mounting fingers 36 (FIG. 3) which are positioned and adapted to mate with or rest upon the ledges 24 and 25 and on the cooperating flats 26 and 27 formed within the housing interior 29. Thus, the winding coils are preliminarily positioned within the housing 11. Flanges 36 may be adhesively secured to the flats 26 and 27 if desired.

Figure 5:
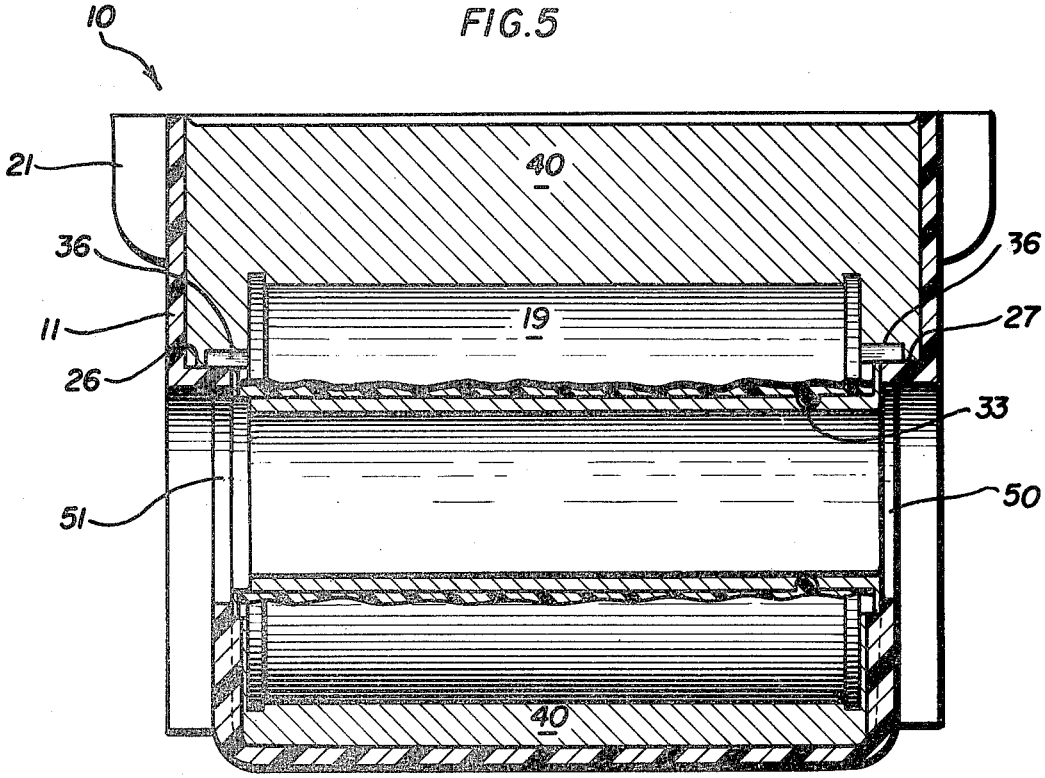
FIG. 5 is a side elevational view taken in partial section and being substantially similar to FIGS. 2 and 4 but showing the transformer assembly with the temporary core pin removed.

To provide the desired electrical insulative qualities, and to secure the various parts within the housing 11, the housing interior 29 is filled with a potting compound 40 (FIGS. 4 and 5). This potting compound is caused to invest or fill those spaces 41 between the individual turns of the wire coils 13, 15, 17 and 19 and the adjacent sleeves 14, 16 and 18 and the bobbin 12 itself. In accordance with the present invention, the housing 11 and mounted parts are first heated to a suitable temperature and thereafter subjected to a suitable vacuum on the order of 100 microns. The potting compound, in its molten or liquid state, is then introduced into the housing interior 29. Under these conditions, the potting compound 40 substantially fills the housing interior 29 and flows between the winding coils and adjacent winding structure to provide the desired electrical insulation to the coils in an intimate manner.

Moreover and in accordance with an important feature of the present invention, a layer 48 of potting compound is formed between the internal surface of the bobbin 12 and the external surface of core pin 32 so as to accommodate a subsequent insertion of a ferromagnetic or other type of transformer core leg (not shown) and to achieve total encapsulation of the coil assembly within the housing 11. To this end, providing first heat and then vacuum to the preliminarily assembled unit prior to introduction of the potting compound 40 has the effect of axially extending the polytetrafluoroethylene core pin 32 so as to expand the core pin into snug engagement with confronting flats 44 and 45 formed on the casing walls 28. Sealing the ends of pin 32 against flats 44 and 45 exposes the annular space between the pin 32 and bobbin 12 to the subsequently applied vacuum and ensures invasion of the potting composition. Presence of a continuous layer of potting compound on the interior of bobbin 12 compensates for imperfections in the union of the material of casing 11, and this is particularly important at the high voltage end of the transformer.

Thereafter, the potted assembly is cooled and circular blanks 46 and 47 are cut out or reamed from the casing wall, in alignment with the opposite ends of the core pin 32 and oversize with respect to the respective ends of the core pin, as is suggested in FIG. 4. Next, the core pin itself is forced from its position within the assembly generally in the direction of arrow 50 to leave a cylindrical cavity surrounded by the layer 48 of potting compound. After appropriate quality control procedures are accomplished, one leg of a C-shaped transformer core is inserted into the cavity left by the pin 32, generally through the apertures 50 and 51 defined by the removal of the blanks 46 and 47.

The drawings and the foregoing descriptions are not intended to represent the only forms of the invention in regard to the details of its construction and method of manufacture. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated in the following claims.

I claim:

1. The method of making a transformer unit which comprises the steps of: forming an electrically conductive transformer winding on a tubular bobbin; inserting a heat-expandable core pin into the tubular bobbin; locating the wound bobbin and core pin assembly in the interior of a casing; heating the casing and winding and thereby expanding the core pin to contact the casing; subjecting the heated casing interior and winding to a vacuum; introducing a liquid potting composition into the casing; causing the potting composition to flow between the core pin and bobbin so as to form an electrically insulative coating inside the bobbin hollow; permitting the potting composition to solidify; and removing the core pin from the bobbin leaving a layer of potting compound inside the bobbin hollow and in substantial confluence with the potting compound inside the casing.

2. The method according to claim 1 which further comprises the steps of forming at least one hole in the casing adjacent one end of the core pin after solidification of the potting composition and removing the pin through the hole.

3. The method according to claim 1 which further comprises the steps of forming holes in the casing adjacent each end of the core pin after solidification of the potting composition and removing the pin through one of said holes.

4. The method according to claim 1 which further comprises the step of positively spacing the core pin from the interior wall of the bobbin.

5. The method according to claim 1 wherein said casing is provided with abutment faces for confronting the ends of the core pin.

* * * * *